US005178841A

United States Patent [19]

Vokins et al.

[11] Patent Number: 5,178,841

[45] Date of Patent: Jan. 12, 1993

[54] STERILIZING APPARATUS

[75] Inventors: Ian M. Vokins, Oxfordshire; James B. Abbott, Berkshire, both of United Kingdom

[73] Assignee: FMC Corporation, Chicago, Ill.

[21] Appl. No.: 776,499

[22] Filed: Oct. 11, 1991

[30] Foreign Application Priority Data

Oct. 13, 1990 [GB] United Kingdom ..... 9022268
Jan. 21, 1991 [GB] United Kingdom ..... 9101257

[51] Int. Cl.[5] ..... A61L 2/06

[52] U.S. Cl. ..... 422/298; 422/28; 422/302; 422/304; 422/306; 53/425; 53/431; 53/432

[58] Field of Search ..... 422/28, 29, 32, 297, 422/298, 302, 304, 306; 53/425, 431, 432

[56] References Cited

U.S. PATENT DOCUMENTS 4,707,334 11/1987 Gehard ..... 53/425
4,742,667 5/1988 Müller et al. ..... 422/302
4,797,255 1/1989 Hatanaka et al. ..... 422/304
4,898,713 2/1990 Picard ..... 422/298
4,992,247 2/1991 Foti ..... 53/425
5,071,667 12/1991 Grüne et al. ..... 53/425

FOREIGN PATENT DOCUMENTS 0199835 8/1989 Japan ..... 53/425
8701293 1/1989 Netherlands ..... 53/425

*Primary Examiner*—Robert J. Warden
*Assistant Examiner*—Laura E. Collins
*Attorney, Agent, or Firm*—Ronald C. Kamp; R. B. Megley

[57] ABSTRACT

An apparatus for sterilizing containers, such as beakers, on a line of an aseptic food packaging machine has a sintered stainless steel tube (6) surrounded by an outer tube (7) which has a plurality of outlets (10). A source of hydrogen peroxide ($H_2O_2$) (1) is vaporized by heated air (4) and passed into the sintered tube (6), from where it permeates to the outer tube (7) and via the outlets (10) to respective containers (18), to sterilize the containers. The combination of the sintered tube and outer tube serves to evenly distribute the $H_2O_2$ vapor to evenly sterilize a row or beakers, indexed through the apparatus.

9 Claims, 3 Drawing Sheets

STERILIZING APPARATUS

This invention relates to sterilising apparatus. In particular it relates to an apparatus for sterilising containers, such as cups or beakers, prior to filling the container with a food product and subsequent sealing.

One material which is widely used for sterilising containers and machinery, which are to come into contact with food products, is hydrogen peroxide ($H_2O_2$) which is particularly active in its vapour form. In a typical aseptic food packaging machine, hydrogen peroxide is used both to sterilise the machine itself and to sterilise the containers which are to receive the food product prior to them being sealed and shipped. To sterilise the containers, $H_2O_2$ is conventionally injected directly, in the form of droplets, into the container and is then heated to vaporise it and thus activate its sterilising properties. The heating process therefore sterilises and subsequently dries the container in preparation for filling it with the food product.

This process has several disadvantages. Firstly, it is difficult to obtain efficiently an even distribution of $H_2O_2$ droplets in a container, particularly if the container is of awkward shape, by a direct injection process. This can result in incomplete sterilisation if areas of the container are not properly coated and hence not sterilised. Furthermore, since the heating process must be long enough both to firstly vaporise the $H_2O_2$ droplets and secondly to drive the vapor out after sterilisation and dry the container, a relatively long drying stage is required in the aseptic machinery. Typically, the drying stage may have a length of around half a meter or so in a machine of the type which conveys containers through various stages of sterilisation, drying, filling and sealing. If such a long drying stage were not required, some of the space could be more usefully utilized for other purposes. Furthermore, the time required to dry the containers can be considerable since a large amount of energy is required to first vaporise and then dry off the $H_2O_2$ droplets. Thus, the yield, in terms of completed food packages per minute, is not as high as it could be.

It is an object of the present invention to provide an improved sterilisation apparatus.

According to the present invention there is provided apparatus for sterilising containers, comprising an input for a source of sterilant, means for vaporising the sterilant, a first chamber adapted to receive the vaporised sterilant and having walls which are permeable to the vaporised sterilant, and a second chamber, substantially enclosing the first chamber, for receiving the permeated vaporised sterilant and having a plurality of outlets through which the vaporised sterilant passes towards a plurality of respective containers to sterilise the containers.

The sterilant is preferably $H_2O_2$, but other sterilants may be used if appropriate.

The outlets may be nozzles and are preferably arranged such that, as containers are passed thereunder, the longitudinal axis of each container lies slightly off axis with respect to the nozzle. It has been found that this improves the efficiency of sterilisation of the containers.

The vaporising means may be a source of heated air. In one embodiment, the sterilant is introduced as a fine spray of droplets which are entrained in a stream of pressurised hot air into the first chamber. In an alternative embodiment, the sterilant and hot air are introduced into a third chamber, where the sterilant is vaporised, this third chamber tube being mounted inside a fourth chamber which receives the vaporised sterilant and feeds it to the first chamber.

The first chamber is most preferably a sintered tube of stainless steel which is closed at one end and therefore serves to distribute the vaporised $H_2O_2$ along its length. The second chamber may also be a tube, which is closed at both ends and is non-permeable. Preferably, the third chamber is a sintered tube.

It has been found that the combination of the first and second chambers serves to evenly distribute the sterilant such that, if the outlets or nozzles are spaced apart in a line receding from the input to the first chamber, a substantially equal amount of sterilant is received by each nozzle. In a preferred embodiment, six nozzles are provided but a greter or lesser number may be provided if desired.

The sterilising apparatus may form part of a food packaging machine of the type in which sets of containers are indexed through the machine. The machine may also comprise an apparatus prior to the sterilising apparatus for preheating the containers. This preheating can help to activate the vaporised $H_2O_2$. The machine may further comprise a drying apparatus after the sterilising apparatus, which essentially comprises means for applying hot air or other gaseous substance to the containers.

Embodiments of the invention will now be described by way of example only with reference to the accompanying diagrammatic drawings in which.

The following description is of a sterilising apparatus forming part of a larger aseptic food packaging machine in which the food product is placed into sterilised beakers and the beakers are sealed. It should, however, be noted that the invention is also applicable to stand-alone sterilising apparatus.

Figure 1:
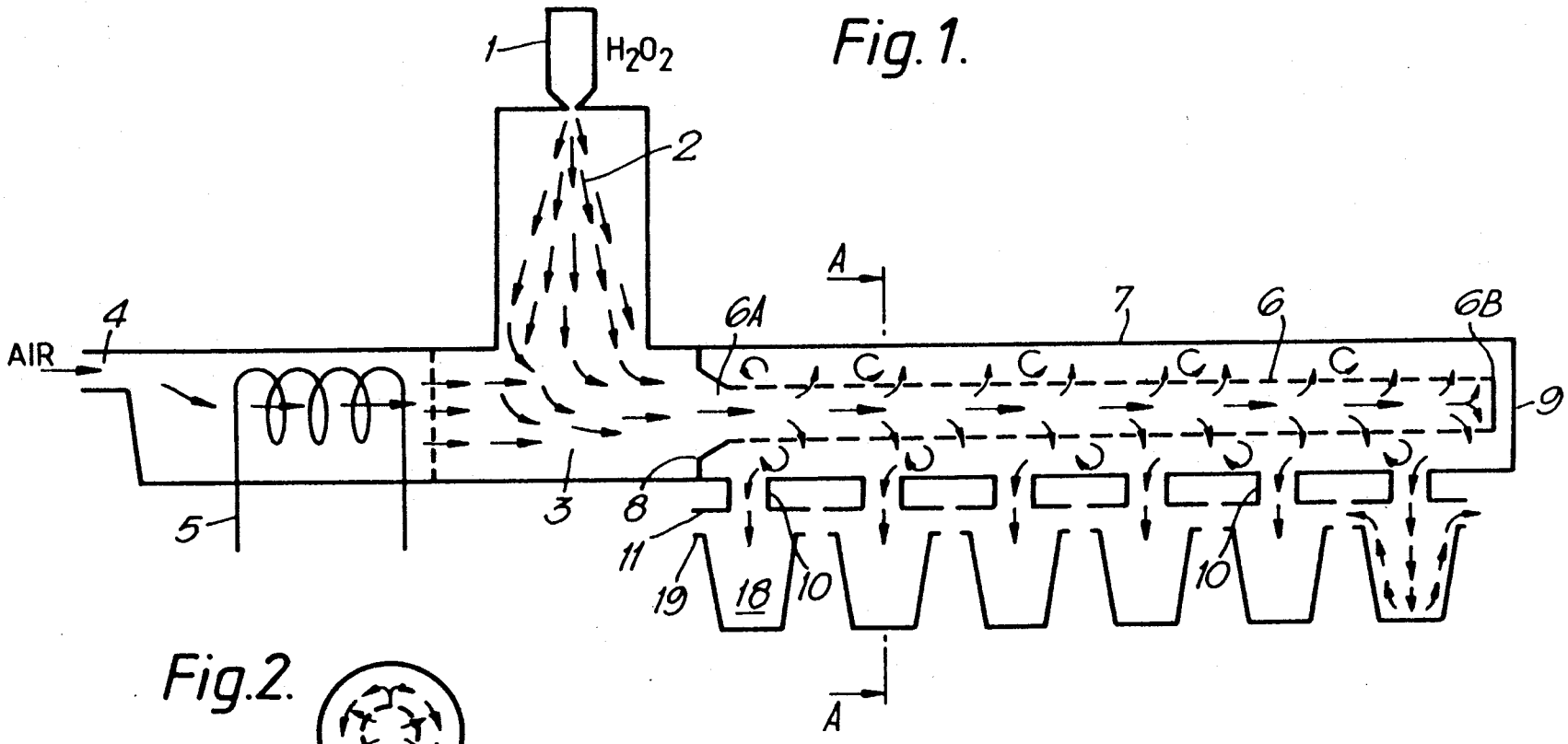
FIG. 1 shows schematically a sterilising apparatus.

FIG. 1 shows a sterilising apparatus for sterilising rows of beakers, each row containing a plurality of beakers which are moved in an indexing motion into the plane of the paper in FIG. 1. One row of six beakers 18 is shown in the Figure. The apparatus comprises a hydrogen peroxide ($H_2O_2$) source 1 arranged to emit a fine spray of $H_2O_2$ droplets in a generally conical spray 2 into a vaporising chamber 3. The vaporising chamber 3 also receives an input of heated air under pressure. Pressurized air is passed through an input nozzle 4 via a heater 5 into the vaporising chamber 3 where it entrains the $H_2O_2$ droplets and, due to its heat, vaporises the $H_2O_2$. The thus vaporised hydrogen peroxide is entrained with the air into a sintered tube 6. The sintered tube is shown as a dashed outline in the figure to indicate its permeable nature. It is typically a stainless steel tube and may be, perhaps, 30 cm or so in length. As shown in the figure, the tube is only open at one end 6A and is closed at the other end 6B. Sintered tube 6 is enclosed within an outer coaxial tubular member 7 which is closed at both ends by, respectively, a generally disc-shaped baffle 8 or plate at the end adjacent the open end 6A of sintered tube 6 and by an end wall 9.

Spaced along the bottom surface of outer tube 7 are a plurality, in this case six, of nozzles 10. The nozzles are typically of 1 cm diameter in this embodiment. At the bottom edge of each nozzle 10, a disc-shaped deflector 11 is mounted. The inner radius of the disc deflector is equal to that of the nozzle such that the deflector can fit securely against the nozzle and the outer radius is approximately equal to the radius, including any rim, of a beaker 18 or other container to be sterilised. The reasons for the deflector will become clear but are essentially so that the top surface of the beaker or other container, including the rim, is properly sterilised.

Figure 3:
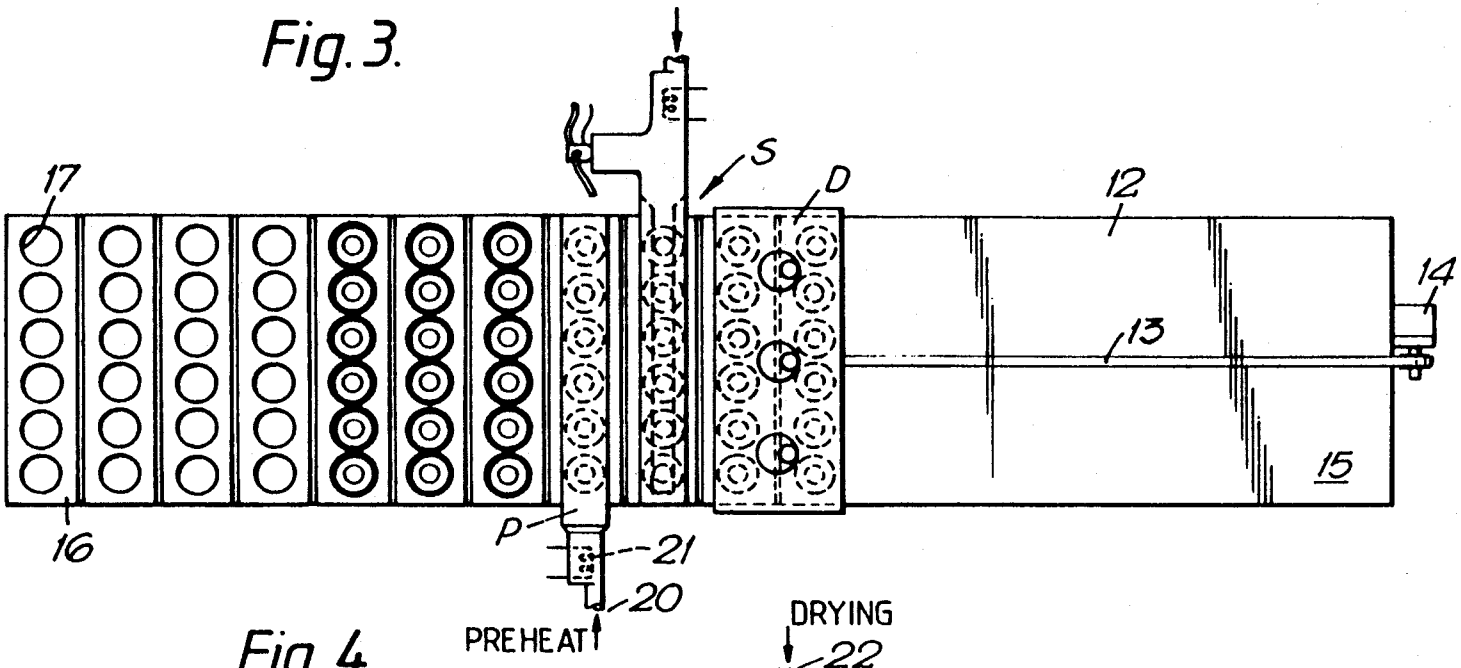
FIG. 3 shows a schematic plan view of sterilising apparatus.
Figure 4:
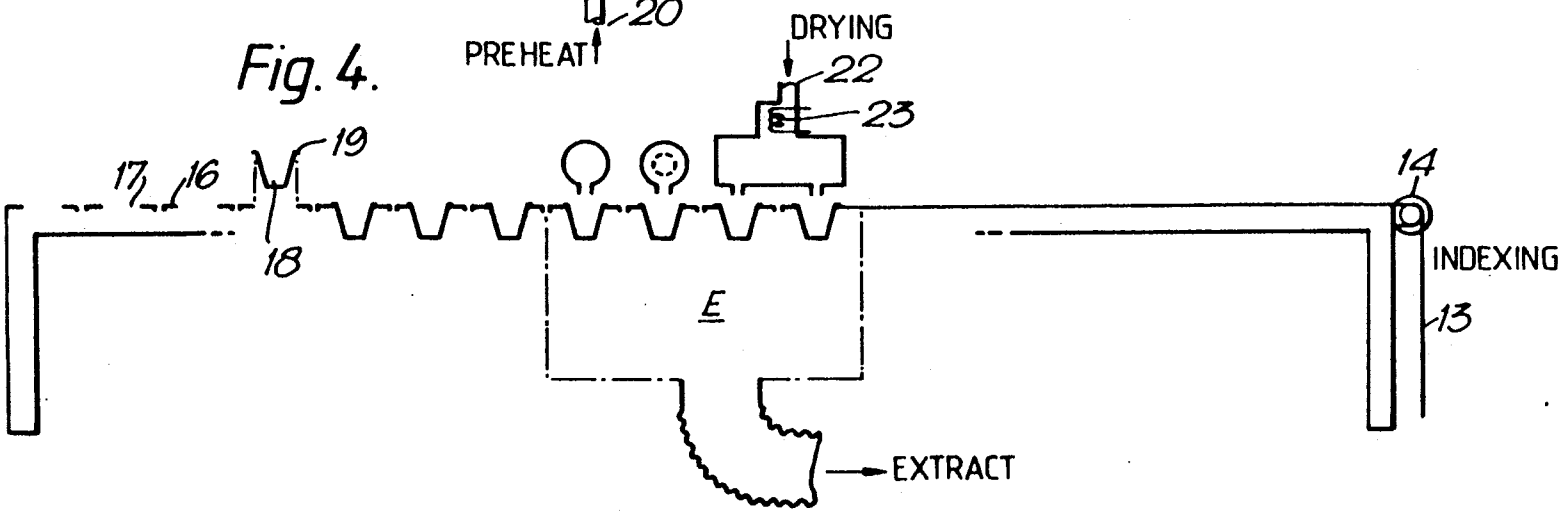
FIG. 4 shows a schematic side view of the apparatus of FIG. 3.

As shown in FIGS. 3 and 4, the sterilising apparatus, which is referred generally as S in these figures, is mounted as one station of the aseptic food packaging machine over a conveyor mechanism 12. This comprises one or more conveying belts 13 which are driven by an indexing stepper motor 14 over a conveying table or surface 15. A series of plates 16, each having a row of six apertures 17 for receiving beakers or other containers 18 are mounted on the conveyor to be moved from left to right in FIGS. 3 and 4 in an indexing motion, with a predetermined time between indexing movements sufficient for a sterilised operation to be performed on beakers held captive within the plates 16. Thus, apertures 17 are of a diameter greater than the diameter of the body portion of a beaker 18 but less than the diameter of the rim 19 of the beaker.

Alternatively, collars may be mounted with the apertures. The collars may be of smaller depth than plate 16 and therefore allow the apparatus to support necked containers, which containers could not be held in a relatively deep plate. Also, the apertures can then be of one size and various sized collars can be fitted, to enable various diameters of container to be sterilised.

The food packaging machine shown in this embodiment includes, in addition to the sterilising station S, a preheat station P mounted directly prior to the sterilising station and a drying station D mounted immediately after the sterilising station S. Both preheat station P and drying station D are optional. Preheat station P comprises a tube similar in dimensions to the outer tube 7 of the sterilising stations and also including the nozzles 10. Air enters through a nozzle 20 and passes over a heater 21 into the tube. The heated air is then applied through the nozzles to respective rows of containers 18 as they are indexed through to preheat the interior surface of the containers. The preheating helps to improve the sterilising of the containers. Drying station D again includes an inlet for an air supply 22 and a heater 23. In this embodiment, the drying station is of two indexing lengths, as shown more clearly in FIG. 4, such that drying (heated) air is applied to a row of beakers for a period of time equal to twice that used for the sterilisation process.

Stages P, S and D take place over an extractor mechanism E which removes excess air and $H_2O_2$ from the system in conventional manner.

It has been found preferable to offset the positions of the nozzles 10 of the sterilising apparatus S with respect to the longitudinal axis of the beakers 18. Thus, nozzles 10 (See FIG. 1) are mounted so that their longitudinal axes are slightly offset from the centre axis C of each beaker. It has been found that this offset placing improves the sterilisation of the beaker and enables vaporised $H_2O_2$ to flow to all parts of the beaker. The offset is typically 10 mm or so. This may vary dependent upon factors such as the type and shape of container.

Figure 2:
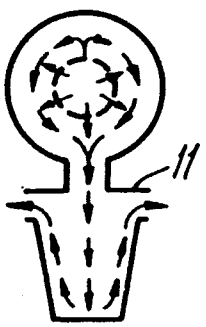
FIG. 2 is a cross-section through A—A of FIG. 1.

In use, when a row of beakers to be sterilised is indexed underneath the row of nozzles 10, a fine spray of $H_2O_2$ is emitted from the $H_2O_2$ source 1. It is entrained in the flow of air injected at 4 and is also vaporised thereby in the vaporisation chamber 3. The $H_2O_2$ vapor/air mixture passes into the sintered tube 6 which serves to evenly distribute the mixture over its length. Due to the sintered nature of the tube, the mixture is diffused out of the wall and into the outer tube 7. The path of the mixture is shown by the arrows in the figure. Since the outer tube 7 is closed, except at the nozzles, the $H_2O_2$ vapor eventually escapes through the nozzles after its pressure has been substantially equalised along the length of the tube. Thus, the pressure of $H_2O_2$ vapor at the nozzle furthest from the $H_2O_2$ source 1 will be substantially equal to the pressure at the nozzle nearest thereto. The vapor then passes through each respective nozzle and into the respective beakers 18. As shown in FIG. 2, the vapor diffuses along substantially the entire inner surface of the beaker and evenly covers the relevant parts of the beaker to sterilise it in known manner. Part of the vapor rises up the inner walls of the beaker and the excess vapor escapes around the rim. Deflector plates 11 serve to direct some of this excess vapour back onto the rim to ensure that the rim itself is effected by the $H_2O_2$ and that the vapor does not miss the rim and hence not sterilise it.

The row of beakers is then indexed forward into the drying stage, where the $H_2O_2$ droplets are driven off, leaving the beakers completely sterilised. They may then be passed to a further part of the machine, or a different machine, for filling if desired.

The $H_2O_2$ source and air source may be pulsed in synchronism with the indexing of beakers or may be arranged to continuously provide a vapor. Any unused vapor is extracted at E and may be recycled if desired. Typically, the temperature of the air after passing through the heater is arranged to provide at least the vaporisation temperature for a solution of 35% $H_2O_2$ in $H_2O$, which is 108° C. The drying stage may heat air to a temperature of, say 250° C. which is generally sufficient to provide a drying temperature of around 150° by the time the air reaches the bottom of a beaker or container. This is obviously dependent upon, inter alia, the depth of container.

With the embodiment described above, it may sometimes be found that the hydrogen peroxide is not completely vaporised in the vaporising chamber 3 and that liquid hydrogen peroxide tends to build up in the chamber. This may lead to incomplete sterilisation and also means that the functioning of the machine cannot be accurately monitored since the amounts of $H_2O_2$ vapor emitted will vary. In most applications this effect is not important, but where careful monitoring and confirmation of sterilising is required the apparatus may be modified as shown in FIG. 5.

Figure 5:
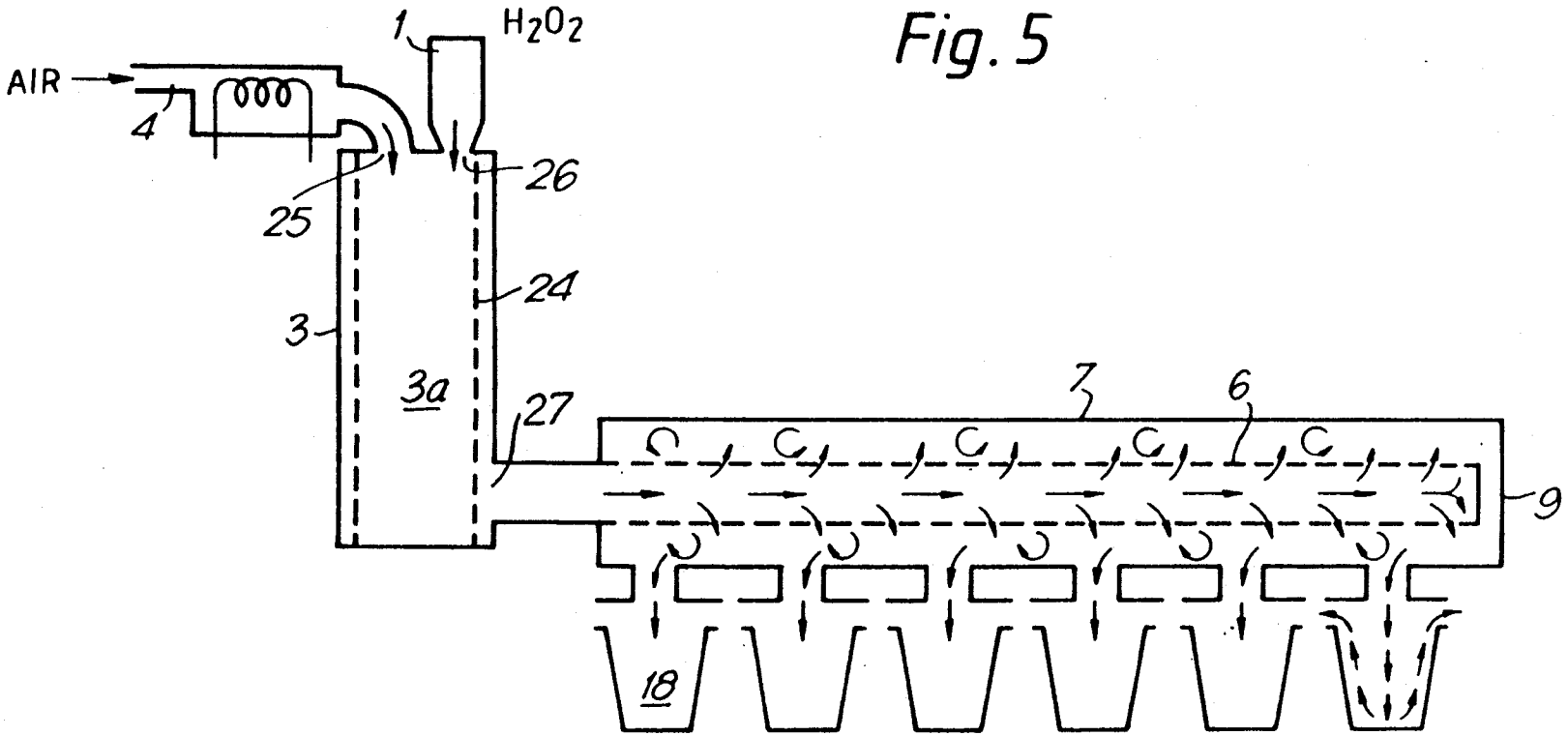
FIG. 5 shows schematically a second embodiment of a sterilising apparatus.

FIG. 5 shows an apparatus similar to that of FIG. 1, in which like parts are denoted by like reference numerals, but having a modified vaporisation chamber assembly **3*a*. The chamber 3*a* is elongate and envelopes a further sintered tube 24. Sintered tube 24 is preferably made of stainless steel and has one closed end. At its other end are respective inputs 25, 26 for heated air 4 and for $H_2O_2$ from a source 1. An outlet 27 from the chamber assembly 3*a* feeds directly the sintered tube 6, from where vaporised $H_2O_2$ is supplied to a row of containers 18 in the manner described with reference to FIG. 1**.

In one example, the stainless steel sintered tube 24 has pores of 25 micrometers, diameter. The chamber assembly 3*a* may comprise a proprietary filter made of a sintered material. Alternatively, the assembly may be made of a separate sintered tube and outer chamber.

In use, both heated air and $H_2O_2$ droplets are fed, via respective inputs 25, 26 into the sintered tube 24 which acts as the vaporising chamber. The $H_2O_2$ is thoroughly vaporised and the vapor escapes through the pores of tube 24 into the outer chamber, from where it is fed into sintered tube 6. The $H_2O_2$ is more efficiently vaporised in this apparatus.

We claim:

1. Apparatus for sterilising containers, comprising:

means steam forming for forming a stream of heated gas containing a vaporised sterilant;

a first chamber connected to said forming means steams to receive said stream of heated gas containing a vaporised sterilant and having walls which are permeable to said vaporised sterilant and a second chamber substantially enclosing said first chamber for receiving the permeated vaporised sterilant, said second chamber having a plurality of outlets through which the vaporised sterilant passes towards a plurality of said containers.

2. Apparatus as claimed in claim 1, wherein said stream forming means comprises:

nozzle means for injecting droplets of hydrogen peroxide into heated air.

3. Apparatus as claimed in claim 1 wherein said stream forming means includes heater means for heating air and nozzle means for injecting droplets of liquid sterilant into said air to vaporise said liquid sterilant.

4. Apparatus as claimed in claim 3, wherein the stream forming means comprises a third chamber adapted to receive the liquid sterilant and the air and permit vaporisation of the liquid sterilant therein, said third chamber having walls which are permeable to the vaporised sterilant, and a fourth chamber, substantially enclosing the third chamber, for receiving the vaporised sterilant and having an outlet to deliver the vaporised sterilant to the first chamber.

5. Apparatus as claimed in claim 1, wherein the first chamber is a sintered tube which is closed at one end.

6. Apparatus as claimed in claim 5, wherein the second chamber is generally tubular and has a row of outlets spaced apart along its length.

7. Apparatus as claimed in claim 1, wherein the outlets of the second chamber are nozzles which are each arranged to direct said vaporised sterilant along a line which is off-set from the central longitudinal axis of a container.

8. Apparatus as claimed in claim 4, wherein the third chamber is a sintered tube.

9. Apparatus as claimed in claim 4, wherein the fourth chamber is generally tubular.

* * * * *

UNITED STATES PATENT AND TRADEMARK OFFICE

CERTIFICATE OF CORRECTION

PATENT NO. : 5,178,841

DATED : January 12, 1993

INVENTOR(S) : IAN M. VOKINS ET AL

It is certified that error appears in the above-indentified patent and that said Letters Patent is hereby corrected as shown below:

Column 5, Claim 1, line 2, insert --strean forming-- in front of the word "means"; line 4, insert --stream-- in front of the word "forming"; line 5, delete "steams"; line 9, delete "the"; and line 12, delete "said".

Signed and Sealed this

Tenth Day of May, 1994

Bruce Lehman

*Attest:*

BRUCE LEHMAN

*Attesting Officer*

*Commissioner of Patents and Trademarks*